United States Patent [19]

Strempel et al.

[11] 4,033,848

[45] July 5, 1977

[54] WAFER ELECTRODE FOR AN ELECTROLYTIC CELL

[75] Inventors: Thomas G. Strempel, Madison; Charles J. Hora, Willoughby Hills, both of Ohio

[73] Assignee: Diamond Shamrock Corporation, Cleveland, Ohio

[22] Filed: Oct. 15, 1975

[21] Appl. No.: 622,702

[52] U.S. Cl. ..... 204/284; 204/87; 204/263; 204/275; 204/279

[51] Int. Cl.[2] ..... C25B 11/00

[58] Field of Search ..... 204/279, 284, 257, 258, 204/275, 263

[56] References Cited

UNITED STATES PATENTS

| | | | |
|---|---|---|---|
| 2,812,301 | 11/1957 | Rideal et al. | 204/284 |
| 3,244,608 | 4/1966 | Strickler | 204/195 T |
| 3,441,488 | 4/1969 | Onstott | 204/275 |
| 3,728,244 | 4/1973 | Cooley | 204/275 |
| 3,876,517 | 4/1975 | Raetzsch et al. | 204/256 |

*Primary Examiner*—T. Tung
*Attorney, Agent, or Firm*—Bruce M. Winchell

[57] ABSTRACT

Disclosed is an improved wafer electrode for use in an electrolytic cell, having an access tube to direct a fluid across the electrode plate or to remove fluid from near the electrode plate within the cell. Cells employing the subject wafer electrode in an electrolytic cell can be used for various electrochemical processes such as for the production of alkali metal carbonates.

4 Claims, 4 Drawing Figures

WAFER ELECTRODE FOR AN ELECTROLYTIC CELL

BACKGROUND OF THE INVENTION

The present invention relates generally to a new wafer electrode for use in an electrolytic cell for the electrochemical production of various compounds. More particularly the present disclosure relates to an improved wafer type electrode having an access tube which is particularly suitable for use as a cathode in an electrolytic cell containing a membrane for the electrochemical production of alkali metal carbonates.

Numerous types of electrodes in the form of anodes and cathodes have been proposed for various electrolytic cells for electrochemical processes. Most of these electrodes fall within two major groups. The first group employs electrodes of a more or less cylindrical nature attached to base plates from opposing ends of an electrolytic cell and arranged in a plurality of rows and columns to provide a honeycomb of anodes and cathodes in spaced relation to each other. These electrodes are generally foraminous and made of a screen or a mesh type of material so that a diaphragm may be formed over them as may be desired for a particular electrochemical process. The geometry of these resultant cell structures makes it exceedingly inconvenient to place a planar membrane between the anodes and cathodes. Hence the second group consists of planar electrodes which may be disposed within an electrolytic cell coplanarly spaced apart in close proximity of each other allowing placement of a planar membrane therebetween. Electrodes of this type are supplied with electrical current through current distribution bars from the opposing ends of an electrolytic cell and also structurally support electrode plates. This arrangement is inadequate because precise placement of the electrodes is difficult thus resulting in certain operational inefficiencies.

Further, it is desirable to have an access port in close proximity of the electrode plate for the introduction or removal of fluids from near the electrode plate surface. In an electrolytic cell for the electrochemical production of alkali metal carbonates, for example, it is necessary to have a stream of $CO_2$ across the cathode plate surface adjacent the membrane. This is difficult to accomplish with the present and existing electrodes as aforedescribed. Another problem which the prior art forms have failed to recognize or solve is the desirability of obtaining an even flow and distribution of the fluid across the electrode plate surface.

SUMMARY OF THE INVENTION

It is therefore an object of the present invention to provide a wafer electrode which is capable of insertion into an electrolytic cell that will achieve a good operating efficiency.

It is another object of the present invention to provide a new wafer electrode having an access tube to disperse a fluid across the electrode plate surface or to remove fluids from within the cell near the electrode plate surface.

It is a further object of the present invention to provide a wafer electrode suitable for use as a cathode wherein carbon dioxide can be blown and even dispersed across the cathode plate surface between the cathode plate and the membrane of an electrolytic cell for the production of alkali metal carbonates.

These and other objects of the present invention, together with the advantages thereof over existing and prior art forms which will become apparent to those skilled in the art from the detailed disclosure of the present invention as set forth hereinbelow, are accomplished by the improvements hereinafter shown, described and claimed.

It has been found that an improved wafer electrode may be constructed having a foraminous electrode plate, at least one annular flange connected to said electrode plate and having an outer peripheral edge and an inner circumferential edge, an access tube extending from the outer peripheral edge to the inner circumferential edge of the annular flange so as to define a passageway therebetween, and a means for connecting an electrical supply source to the electrode plate.

One preferred embodiment of the subject improved wafer electrode is shown by way of example in the accompanying drawings without attempting to show all of the various forms and modifications in which the invention might be embodied; the invention being measured by the appended claims and not by the details of the specification.

DESCRIPTION OF THE PREFERRED EMBODIMENT

Figure 1:
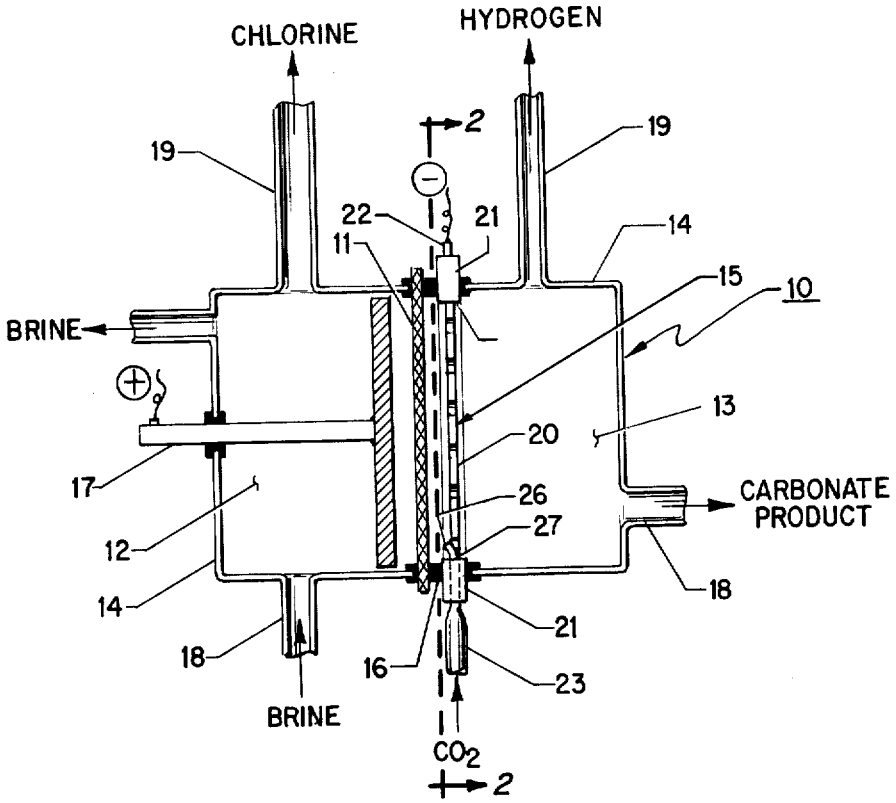
FIG. 1 is a side section view of an electrolytic cell which can be used for the production of alkali metal carbonates, showing the placement of a wafer electrode therein according to the concepts of the present invention.

Referring to the drawings numeral 10 generally refers to an electrolytic cell capable, for example, of being used for the electrochemical production of alkali metal carbonates. Those skilled in the art will readily recognize that the cell construction of FIG. 1 with only minor alterations could be used for a wide variety of electrochemical processes. The electrolytic cell 10 is divided by a membrane 11 into an anode compartment 12 and a cathode compartment 13 made of two glass cylindrical half cell members 14. Sandwiched between these two half cell members 14 are the membrane 11 and a wafer electrode 15. In the particular electrolytic cell 10 shown in FIG. 1 the wafer electrode 15 serves as the cathode 15. The wafer electrode 15 constructed according to the concepts of the present invention may just as easily be used for anode or an anode and a cathode in similar electrolytic cell structures.

The wafer electrode 15 is connected electrically to the negative terminal of an electrical supply source not shown. The electrolytic cell is sealed by gasketing 16 resistant to chemical attack by the anolyte and catholyte to be used within the cell. The gasketing 16 between the cathode 15 and the membrane 11 may be a material of a specific desired thickness to obtain a given gap between the wafer electrode 15 and the membrane 11. This provides a very convenient and precise method for obtaining the desired gap between the wafer electrode 15 and the membrane 11. Appropriately disposed within the anode compartment 12 is an anode 17 which as seen in FIG. 1 is constructed according to current and existing concepts. The anode 17 is connected electrically to the positive terminal of an electrical supply source not shown to complete an electrical circuit by which an electrolyzing current may be passed through the electrolytic cell 10. The half cell members 14 forming the anode compartment 12 and cathode compartment 13 can each have outlets 18 at the bottom thereof for charging or removing fluids such as brine and alkali metal carbonate product, outlets 19 at the top of the cell generally for the removal of gases such as chlorine and hydrogen and other openings as may be desired for the particular reaction to be performed.

Figure 2:
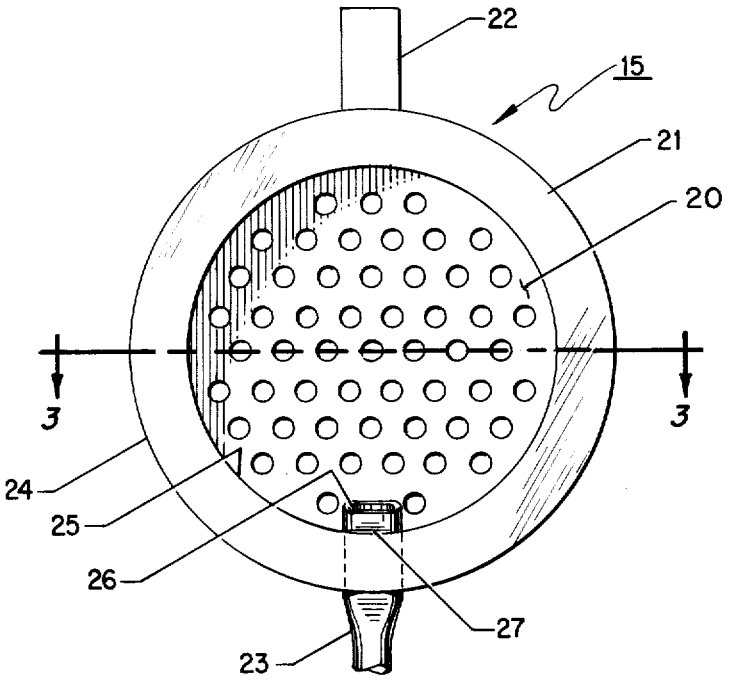
FIG. 2 is a front elevation view of the wafer electrode taken substantially along line 2—2 of FIG. 1.

Looking more particularly to the construction of an electrode according to the concepts of the present invention, FIG. 2 shows the wafer electrode 15 as used in the electrolytic cell 10 pictured in FIG. 1. In this particular electrolytic cell, the wafer electrode 15 is used as the cathode for the electrochemical production of alkali metal carbonates. The wafer electrode 15 has an electrode plate 20 which is the charged portion of the wafer electrode 15. Electrode plate 20 could be made of any material suited to the particular use of the wafer electrode 15 in a particular cell, that not being a limiting factor of the present invention. In the electrolytic cell 10, the electrode plate 20 is foraminous to allow fluid communication through the wafer electrode 15. When the wafer electrode 15 is used as the cathode, the electrode plate 20 may be constructed of conventional electrically conductive material resistant to the catholyte such as iron, mild steel, stainless steel, titanium, or nickel. The electrode plate 20 to be used as an anode may be constructed of any conventional electrically conductive electrolytically-active material resistant to the anolyte such as graphite or, a valve metal such as titanium, tantalum or alloys thereof bearing on its surface a noble metal, a noble metal oxide (either alone or in combination with a valve metal oxide), or other electrolytically active, corrosion-resistant material. Anodes of this class are called dimensionally stable anodes and are well known and widely used in industry. See, for example, U.S. Pat. No. 3,117,023; 3,632,498; 3,840,443 and 3,846,273.

Figure 3:
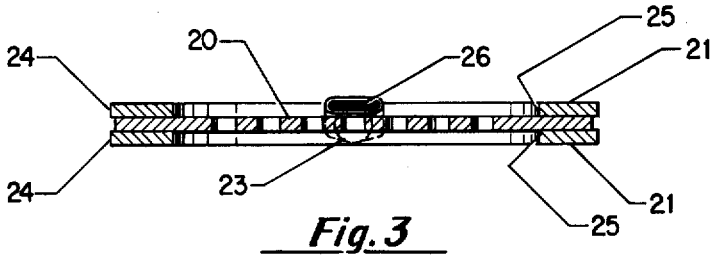
FIG. 3 is a side section view of the wafer electrode taken substantially along line 3—3 of FIG. 2.

Surrounding the electrode plate 20 is an annular flange 21 which may be made of any material suited to the particular use, in this case stainless steel or a plastic material resistant to the chemical environment within the electrolytic cell 10. As seen in FIG. 3 the annular flange 21 is connected to a second annular flange 21 by a sealing engagement at the outer peripheral edge thereof. Sandwiched between these two sealing engaged annular flanges 21 is the electrode plate 20 which is retained between the two annular flanges 21 by weldment at the outer peripheral edge of the annular flanges.

One could just as easily use only annular flange 21 and attach thereto a foraminous electrode plate 20 of smaller dimensions to provide a suitable wafer electrode 15 according to the concepts of the present invention. This arrangement would be advantageous where a very small gap between the membrane 11 and the electrode plate 20 is desired. The wafer electrode 15 in either arrangement will be held in place in an electrolytic cell 10 by clamp pressure upon the annular flange 21. Also the dimensions or shape of the wafer electrode 15 can easily be altered to conform to the dimensions and shape of a particular electrolytic cell such as a rectangular or square shape of varying dimensions.

At the upper end of the wafer electrode 15 is an extension in the form of an electrical contact boss 22 which is used to make the connection between the electrical supply source and the electrode plate 20. As one skilled in the art will realize this boss can be of any shape or design such as to make it convenient for electrical connection of the wafer electrode 15 while within the electrolytic cell 10.

Figure 4:
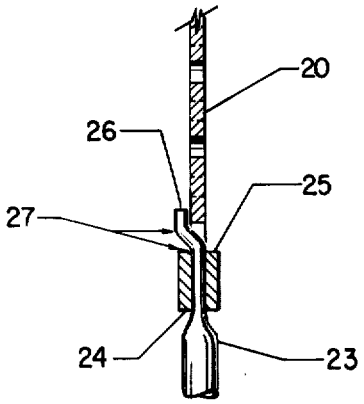
FIG. 4 is a partial side section view of the wafer electrode showing a second alternative for the access tube.

It has been found to be very advantageous to have a means of inserting fluids into a cell during the operation thereof or removing samples from close to the surface of electrode plate 20. The present invention provides an access tube 23 extending from the outer peripheral edge 24 of the annular flanges 21 of the wafer electrode 15 to the inner circumferential edge 25 of the annular flanges 21 so as to define a passageway therebetween to communicate between the inside and the outside of electrolytic cell 10. As seen in FIGS. 3 and 4 of the drawings, the access tube 23 lies in the same plane as electrode plate 20 as it passes through the annular flanges 21. This is accomplished by a cutout portion in the electrode plate 20 to accommodate the access tube 23 as seen in FIG. 4. The access tube 23 can be of any size or shape convenient for the connection of fittings or other tubing thereto as one skilled in the art will realize. It is desirable to have the gas or liquid that is being inserted into the cell 10, dispersed evenly across one surface of the electrode plate 20 and preferably the surface of the electrode plate 20 which is adjacent the membrane 11 as contained in the electrolytic cell 10. The access tube 23 has been flattened on the inside end thereof the provide an insertion orfice 26 for evenly dispersing either a liquid or a gas across the surface of electrode plate 20.

As can be best seen in FIG. 1, the access tube 23 has a bend in it at point 27 such that the insertion orifice will be directed to one side or the other of the wafer electrode 15. FIG. 3 shows the positioning of the insertion orifice with respect to the plate member 20 of the wafer electrode 15 and in relation of the access tube 23 which is round at the outer surface for connection of other hardware. It has found that the carbon dioxide gas supplied to the electrolytic cell 10 used for the electrochemical production of alkali metal carbonates achieves a higher absorption rate when blown more or less tangent to the surface of the electrode plate 20. The bend 27 must be of sufficient extent to achieve this result or there may be two bends to provide an exactly tangential flow of carbon dioxide across the surface of electrode plate 20. FIG. 4 shows an access tube 23 with two bends. Thus, it can be seen that the access tube 23 provides a ready insertion point for liquids or gases to either side of the electrode plate 20 or in the particular electrolytic cell 10, to the side of the cathode plate 20 adjacent the membrane 11. Also this access tube 23 serves as a very convenient point for the removal of samples or product or any desired substance from near the surface of electrode plate 20 within the cell without opening up the cell for access thereto.

A wafer electrode 15 constructed according to the concepts of the present invention as hereinabove described has been found to produce good operation efficiency in an electrolytic cell 10 for the production of alkali metal carbonates. It is believed that this is due at least in part to the increased absorption of the carbon dioxide gas at the surface of the wafer electrode 15 produced by use of the access tube 23 as hereinabove described.

The subject electrode can be made to any size or shape desired, the only difference being that in a large circular or retangular electrode more than one access tube may be necessary to accomplish the even distribution of substances across the plate member 20 surface.

It should be apparent from the foregoing description of the preferred embodiment that the device herein shown and described accomplishes the objects of the invention and solves the problems attendant to such devices as heretofore described.

What is claimed is:

1. A wafer electrode comprising: two annular flanges having an inner circumferential edge and connected by a sealing engagement at an outer peripheral edge thereof; sandwiched between said annular flanges, a foraminous electrode plate retained between said annular flanges by weldment at the outer peripheral edge of said annular flanges; at least one access tube extending substantially in the same plane as said electrode plate from said outer peripheral edge to said inner circumferential edge through said annular flanges so as to define a passageway therebetween; and means for connecting an electrical supply source to said electrode plate.

2. A wafer electrode according to claim 1 wherein said access tube has at least one bend at said inner circumferential edge of said flange so as to direct a fluid across one side of said electrode plate.

3. A wafer electrode according to claim 2 wherein said bend is of sufficient extent as to achieve a tangential flow across said electrode plate.

4. A wafer electrode according to claim 1 wherein said access tube has a smashed insertion orifice for directing an evenly dispersed flow of fluid across said electrode plate.

* * * * *